US006176791B1

(12) United States Patent
Wright

(10) Patent No.: US 6,176,791 B1
(45) Date of Patent: Jan. 23, 2001

(54) GOLF PUTTER

(76) Inventor: Vernon V. Wright, 1934 Strawberry, Pasadena, TX (US) 77502

( * ) Notice: Under 35 U.S.C. 154(b), the term of this patent shall be extended for 0 days.

(21) Appl. No.: 09/167,173

(22) Filed: Oct. 6, 1998

(51) Int. Cl.[7] ..... A63B 53/04; A63B 69/36

(52) U.S. Cl. ..... 473/252; 473/340; 473/313; 473/342

(58) Field of Search ..... 473/340, 341, 473/255, 251, 252, 253, 254, 329, 332, 313, 314, 324, 342; D21/736, 737, 738, 739, 740, 741, 742, 743, 744, 745, 746

(56) References Cited

U.S. PATENT DOCUMENTS

D. 247,791 * 4/1978 Monteleone .
3,042,405 * 7/1962 Solheim .
3,851,877 * 12/1974 Giambazi .
4,199,144 * 4/1980 Skelly .
4,834,387 * 5/1989 Waites .
4,921,253 * 5/1990 Tesori .
4,964,639 * 10/1990 Tucker .
5,308,069 * 5/1994 Paquette .
5,333,863 * 8/1994 Shenoha .
5,458,332 * 10/1995 Fisher .
5,571,052 * 11/1996 Bolanos .
5,690,556 * 11/1997 Condon .
5,830,077 * 11/1998 Yavitz .

* cited by examiner

*Primary Examiner*—Sebastiano Passaniti
(74) *Attorney, Agent, or Firm*—Bracewell & Patterson, L.L.P.

(57) ABSTRACT

A golf putter improves a golfer's ability to consistently impart a smooth putting stroke on the ball. The putter has an elastomer insert extending over a ball striking surface formed on the head of the club head. An inertial mass or ballast is formed at a rear central portion of the club head, with center portions of the ballast mass aligned with the vertical center line of the ball striking surface. The shaft portion of the putter is connected to the club head so that the longitudinal axis of the shaft intersects the center line of the club head and the inertial mass. The club head also has a base plate portion to assist the golfer in club grip and alignment during "set up" before the actual putting stroke.

16 Claims, 2 Drawing Sheets

GOLF PUTTER

BACKGROUND OF THE INVENTION

1. Field of the Invention

The present invention relates to golf clubs, more specifically to putters.

2. Description of the Related Art

No aspect of golf receives any more attention, analysis and study than putting. In a round of even par golf, two strokes per hole are allocated to putts. Golfers are continually working on ways to improve or enhance their scores by reducing the number of putts used. The relatively simply stated principle of smoothly imparting a rolling motion to the ball for movement along its intended path or line, is actually very difficult to repeatedly and consistently achieve. Part of this problem is that the structure of a number of putters is often not of a type that makes it easy for a golfer to accomplish this seemingly easy task. The number and variety of putters used is great; almost every golfer has a different type of particular preferred club design of choice for use as their putter. Even so, a golfer may experiment with a wide variety of putters and putting strokes should a run or series of rounds occur with excessive putts. One of the key factors is confidence of the golfer in an ability to consistently impart a smooth, controlled uniform stroke to the ball so that it moves along its intended line or path of movement at the desired speed.

SUMMARY OF THE INVENTION

Briefly, the present invention provides a new and improved golf putter which improves a golfer's ability to consistently impart a smooth putting stroke on the ball. The putter includes a club head mounted on a lower portion of a club shaft. The club head has a sole plate portion with heel and toe portions extending upwardly from it. A ball contact member formed of an elastomer is mounted with a retainer plate which extends upwardly from the sole plate portion. The retainer plate extends between the heel and toe portions of the club head rearwardly of the elastomer ball contact member.

An inertial mass or ballast of the club head is mounted on the sole plate portion rearwardly of the retainer plate and aligned opposite a central portion of the ball engaging or contact face. A hosel or socket is formed in the inertial mass to receive the lower portion of the club shaft. The ball engaging face extends between the heel and the toe portions, over the full lateral extent of the ball contact member and vertically across the front upright surface of the contact member.

With the present invention, a substantial portion of the weight of the club head is formed by the inertial mass, which is centrally located behind the ball contacting member. The elastomer ball contact member imparts a smooth motion to the ball with reduced chance of the ball jumping or skipping off the club face when stroked. Further, the club shaft is connected to the club head at this same central location. Thus, the mass of the club is concentrated or focused in the center part of the ball contact area of the putter. This is also the point of connection of the club shaft to the club head. An alignment indicator or guide is formed on the club head to indicate this central axis or line.

DETAILED DESCRIPTION OF INVENTION

Figure 1:
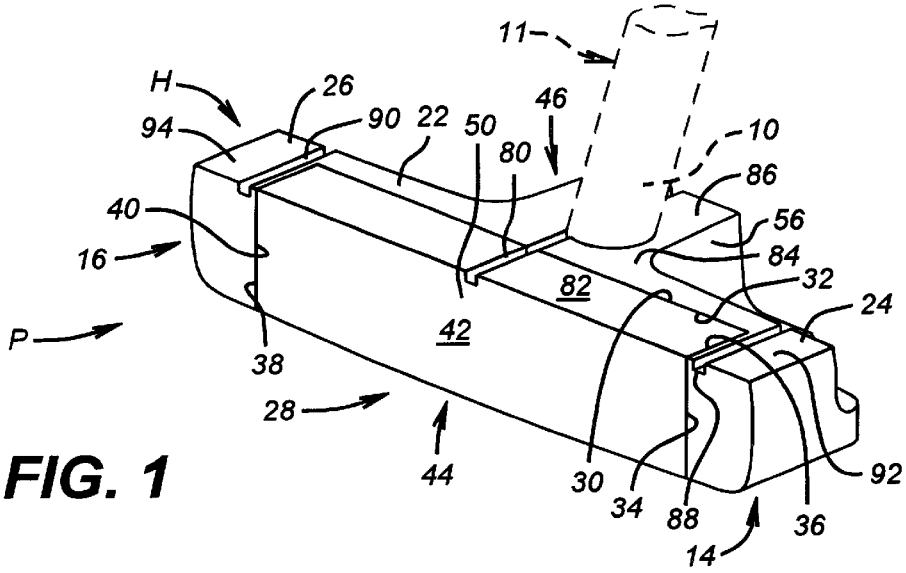
FIG. 1 is a front isometric view of a golf putter according to the present invention, with portions thereof shown in phantom.
Figure 2:
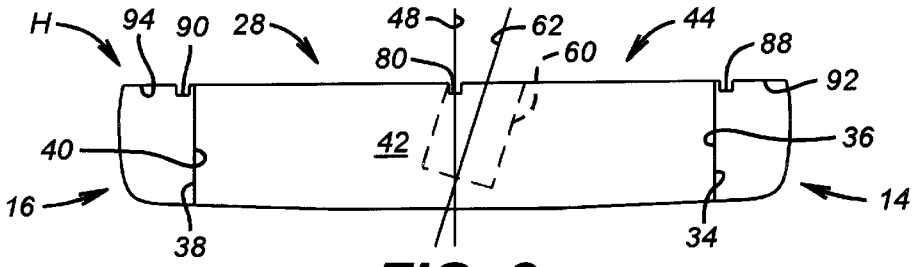
FIG. 2 is a front elevation view of the golf putter of FIG. 1.
Figure 3:
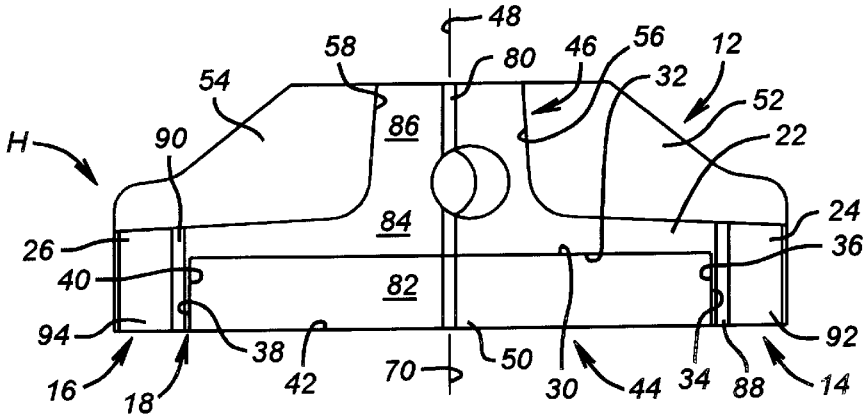
FIG. 3 is a plan view of the golf putter of FIG. 1.
Figure 4:
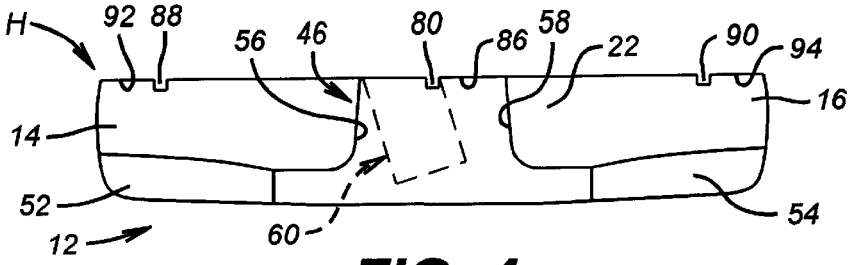
FIG. 4 is a rear elevation view of the golf putter of FIG. 1.
Figure 5:
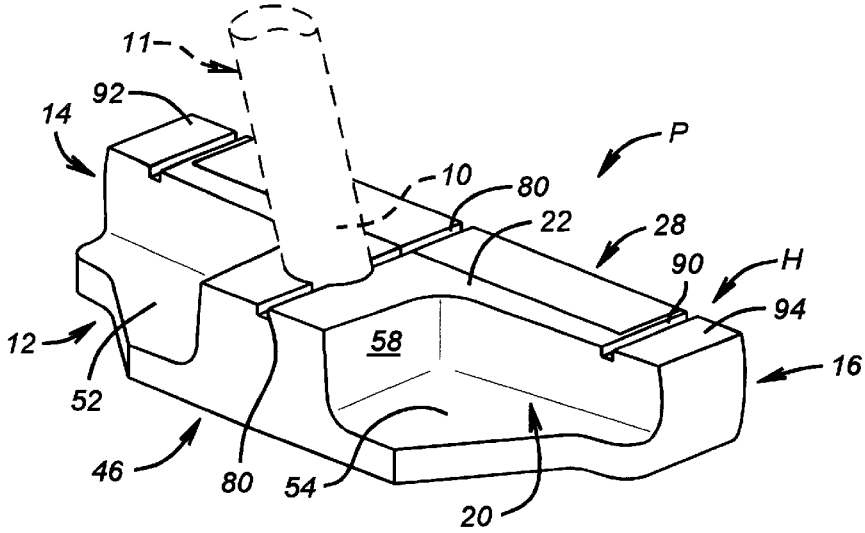
FIG. 5 is a rear isometric view of the golf putter of FIG. 1.
Figure 6:
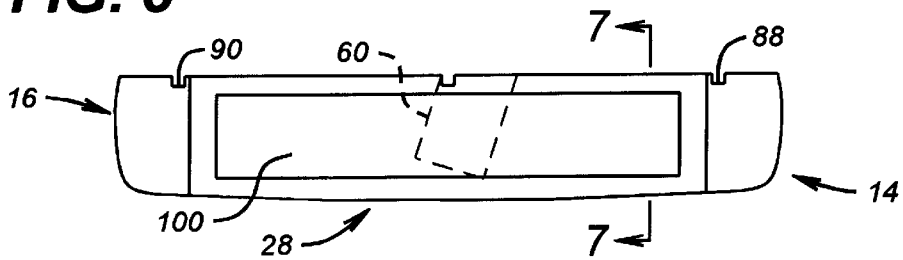
FIG. 6 is a front isometric view of another embodiment of a golf putter according to the present invention, with portions thereof shown in phantom.

In the drawings, the letter P designates generally a new and improved putter according to the present invention. The putter P includes a club or putter head H mounted on a lower portion 10 of a club shaft 11. The club shaft 11 is conventional and may be of any suitable length in its upward extent from the lower portion 10 mounted with the club head H. The club shaft 11, as is conventional, has a club grip (not shown) mounted at its upper end. The club grip may be of any of numerous commercially available types.

The club head H is formed of a suitable metal alloy, such as a manganese alloy and includes a sole plate or face member 12. A heel portion 14 and a toe portion 16 are formed extending upwardly from the sole plate portion 12 of the club head H. The heel portion 14 and toe portion 16 are spaced laterally from each other by a gap 18 on a front portion 20 of the sole plate 12. The gap 18 is formed inwardly of a retainer plate 22 which extends upwardly from the sole plate 12. The retainer plate 22 is formed of the same material as the sole plate 12, heel portion 14, and toe portion 16 and extends laterally between rear portions 24 and 26 of the heel portion 14 and the toe portion 16.

With the present invention, a ball contact member 28 is provided in the club head H. The ball contact member 28 is formed of an elastomer, preferably a polyurethane elastomer of suitable hardness, about ⅜" thick and about 3" in width by ⅞" in height. For example, a polyurethane elastomer having a D scale durometer hardness of at least 65 is suitable for use as the ball contact member 28. The ball contact member 28 is fitted in and fixedly mounted in the gap 18 on the club head H. The ball contact member 28 is mounted by a suitable strength adhesive, such as an epoxy resin, on a rear surface 30 to a front surface 32 of the retainer plate 22. Similarly, the ball contact member 28 is mounted along a first side surface 34 to an inner surface 36 of the heel portion 14. The ball contact member 28 is also mounted in the same manner along a second side surface 38 to an inner surface 40 of the toe portion 16.

The elastomer ball contact member 38 has a ball contact surface 42 formed extending laterally across the full frontal extent of a club face 44 between the metal heel and toe portions 14 and 16 of the club head H. The lateral extent of the ball engaging surface 42 of the ball contact member 38 is preferably three inches or more, thus at least double the diameter of a standard U.S. golf ball. Thus, unless the putter P is intentionally misaligned, the ball when stroked is contacted by the elastomer mass of the ball contact member 28. Contact with the elastomer ball contact member 28 imparts a smooth motion to the ball with reduced chance of the ball jumping or skipping off the club face in the event that slightly irregular or excessively strong stroke is imparted to the ball.

The ball contact surface 42 of contact member 28 extends vertically with substantially no loft upwardly the full vertical extent of the club face 44 and retainer member 24 between the metal heel and toe portions 14 and 16, respectively. Thus, regardless of the height that the club head H is above the ground when the ball is stroked during a putting stroke, the ball begins to roll when it is contacted by the elastomer mass 28 of the ball contact member, again reducing the chance of the ball jumping or skipping off the club face 44. Also, a softer touch can be used in the putting stroke.

The club head H includes an inertial mass or ballast portion 46 formed rearwardly of the retainer plate 22 and ball contact member 28. The inertial mass 46 extends laterally along the retainer plate 28 over a width spaced about a vertical center plane passing through the center of gravity, as indicated at 48 of the ball contact member 28. The inertial mass 46 is thus located opposite a central portion 50 of the ball contact surface 42. In this manner, a substantial portion of the weight of the club head H is represented by the inertial mass 46, which is centrally located behind the ball contacting member 28.

The base or sole plate 12 of the club head H includes side flange members 52 and 54 formed extending rearwardly from the retainer plate 22 and laterally from side walls 56 and 58 of the inertial mass 46. The flange members 52 and 54 along with the base plate portion 12 form a stable, broad generally relatively flat rest or support surface. A golfer may thus rest these portions of the club head H on the ground. This assists the golfer in gripping the club and achieving proper club shaft hand alignment during "setup" before the actual putting stroke, due to the substantial lateral extent of the base plate portion 12 of the club head H.

The inertial mass 46 of the club head H also has a hosel or socket 60 formed extending downwardly therein to receive the lower portion 10 of the club shaft 11. The hosel 60 in the inertial mass 46 has a central longitudinal axis 62 located in a plane passing downwardly through and intersecting the vertical plane 48 formed through the center of gravity of inertial mass 46. The longitudinal axis 62 of the hosel 60 is formed at a suitable angle from the vertical center plane 48, usually between 20° and 30° and preferable approximately 26°, although this may vary depending upon the height of the club user.

The ball contact member 28 similarly has a vertical center plane, as indicated a 70, passing through its center of gravity. The vertical center plane 70 through the ball contact member 38 is aligned with the vertical center plane 48 through the inertial mass 46 at its center of gravity. In this manner, a longitudinal axis of the club shaft 11 co-extensive with axis 62 of the hosel 60 intersects the aligned vertical center planes 48 and 70 through the centers of gravity of the inertial mass 46 and the ball contact member 38.

Thus, the club shaft 11 is connected to the club head H at a central location aligned with the substantial portion of the weight of the club head H, represented by the inertial mass 46. Thus, the mass of the putter P is concentrated or focused in the central part of the ball contact area 50 of the putter P. As has been noted, this is also the point of connection of the club shaft 11 to the club head H.

An aiming indicator or alignment guide groove 80 is formed on the club head H extending from the ball contact surface 42 across a top surface 82 of the ball contact member 28 and a top surface 84 of the retainer plate 22 and a top surface 86 of the inertial mass 46. The alignment guide 80 is formed in alignment with the vertical planes 48 and 70 formed through the centers of gravity of the ball contact member and the inertial mass 46. Thus, a user of the putter P can with guide 80 align a substantial portion of mass of the club, represented by the inertial mass 46 and the ball contact member 28, as well as the connection point between the club shaft 11 and the club head H, with the center line of the ball in aligning a putting stroke.

For additional alignment accuracy, side aiming indicators or alignment guides 88 and 90 are formed in the heel portion 14 and toe portion 16 of the club head H. The alignment indicator 88 is formed in heel portion 14 parallel to aiming guide 80 inwardly of surface 36 extending across an upper surface 92. Similarly, the alignment indicator 90 is formed parallel to aiming guide 80 outwardly from surface 40, and extending across an upper surface 94.

Figure 7:
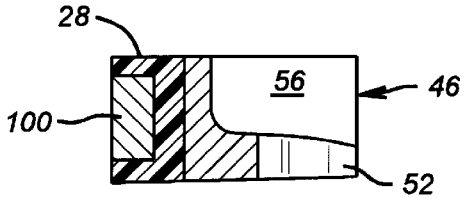
FIG. 7 is a side elevation view, taken partly in cross-section, along the line 7—7 of FIG. 6.
Figure 8:
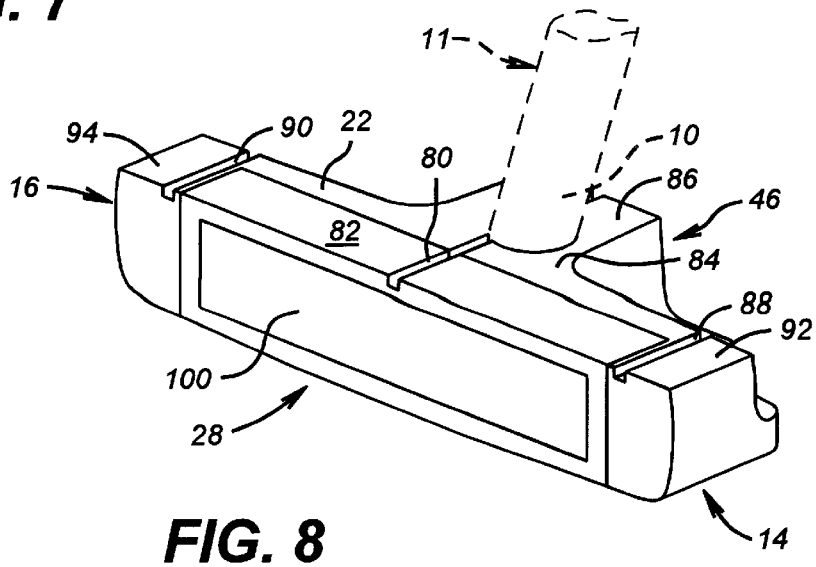
FIG. 8 is a front elevation view of the golf putter of FIG. 6.

In some instances, golfers prefer to have a slight clicking noise or sound when the ball is stroked during a putting stroke. With an elastomer insert, such as the ball contact member 28, this does not occur. For golfers who prefer the noise or sound emitted when the ball is stroked during a putting stroke, a metal insert 100 of brass or other suitable material is integrally formed into the ball contact member across the ball contact surface 42. The metal insert 100, for example, may be about ½" in height, 2-⅜" in width and extend approximately ¼" into the ball contact face 42. It is noted that there is a portion 102 (FIG. 7) of the elastomer insert 28 present behind the metal insert 100 and in front of surface 32 of retainer plate 22. The portion 102 exerts a deadening effect and the metal insert 100 does not increase the likelihood of skipping of the ball off of contact surface 42.

The foregoing disclosure and description of the invention are illustrative and explanatory thereof, and various changes in the details of the illustrated apparatus and construction and method of operation may be made without departing from the spirit of the invention.

What is claimed is:

1. A golf putter comprising:

a club shaft;

a club head mounted on a lower portion of the club shaft, comprising:

a sole plate portion;

a heel portion extending upwardly from said sole plate portion;

a toe portion extending upwardly from said sole plate portion spaced from said heel portion;

a ball contact member being formed of an elastomer;

said ball contact member having a ball engaging face formed on a front upright surface thereof;

said ball engaging face extending laterally between the heel and toe portions over the extent of the ball contact member;

a retainer plate extending upwardly from said sole plate portion rearwardly of said ball contact member and between said heel and toe portions for support of the ball contact member;

an inertial mass mounted on said sole plate portion rearwardly of said retainer plate;

said inertial mass being located opposite a central portion of the ball engaging face;

said inertial mass having a hosel therein for receiving the lower portion of the club shaft;

said inertial mass extending laterally along the retainer plate over a width thereof spaced about a vertical plane passing through the center of gravity of the ball contact member; and said inertial mass extending laterally along the retainer plate over a width less than the diameter of a golf ball.

2. The putter of claim 1, wherein said ball engaging face extends laterally across the front upright surface of the ball contact member.

3. The putter of claim 1, wherein said ball engaging face extends vertically across the front upright surface of the ball contact member.

4. The putter of claim 1, wherein said ball engaging face extends laterally and vertically across the front upright surface of the ball contact member.

5. The putter of claim 1, wherein:

the club shaft is an elongate member with a longitudinal axis; and the hosel in the inertial mass has a longitudinal axis located in a plane intersecting a vertical center plane through the inertial mass at its center of gravity; and the longitudinal axis of the club shaft when mounted in the hosel intersects the vertical center plane of the inertial mass.

6. The putter of claim 1, wherein:

the ball contact member has a vertical center plane through its center of gravity;

the hosel in the inertial mass has a longitudinal axis located in a plane intersecting a vertical center plane through the inertial mass at its center of gravity; and wherein the vertical center planes through the centers of gravity of the hosel and ball contact member are aligned.

7. The putter of claim 6, wherein:

the club shaft is an elongate member with a longitudinal axis; and the longitudinal axis of the club shaft when mounted in the hosel intersects the aligned vertical center planes through the centers of gravity of the inertial mass and the ball contact member.

8. The putter of claim 6, further including:

an aiming indicator formed in the ball contact member and the inertial mass along the aligned vertical centers planes through their center of gravity.

9. The putter of claim 8, further including:

an aiming indicator formed in the heel portion and the toe portion in parallel alignment with the aiming indicator formed in the ball contact member and the inertial mass.

10. The putter of claim 1, wherein the ball engaging face of the ball contact member extends laterally over a width larger than the diameter of a golf ball.

11. The putter of claim 1, wherein the ball engaging face of the ball contact member extends laterally over a width approximately double the diameter of a golf ball.

12. The putter of claim 1, wherein the elastomer of the ball contact member is a polyurethane elastomer.

13. The putter of claim 1, wherein the elastomer of the ball contact member is a polyurethane elastomer having a D scale durometer hardness of at least 65.

14. The putter of claim 1, wherein the sole plate portion has flanges extending rearwardly from the retainer plate and laterally outwardly from the inertial mass.

15. The putter of claim 1, further including:

a metallic insert formed in the ball engaging face of the ball contact member for emitting a sound when the ball is stroked.

16. A golf putter comprising:

a club shaft;

a club head mounted on a lower portion of the club shaft, comprising:

a sole plate portion;

a heel portion extending upwardly from said sole plate portion;

a toe portion extending upwardly from said sole plate portion spaced from said heel portion;

a ball contact member being formed of an elastomer;

said ball contact member having a ball engaging face formed on a front upright surface thereof;

said ball engaging face extending laterally between the heel and toe portions over the extent of the ball contact member;

a retainer plate extending upwardly from said sole plate portion rearwardly of said ball contact member and between said heel and toe portions for support of the ball contact member;

an inertial mass mounted on said sole plate portion rearwardly of said retainer plate;

said inertial mass being located opposite a central portion of the ball engaging face;

said inertial mass having a hosel therein for receiving the lower portion of the club shaft; and said sole plate portion has flanges extending rearwardly from the retainer member and laterally outwardly from the inertial mass.

* * * * *